US011085186B2

(12) United States Patent
Hou et al.

(10) Patent No.: US 11,085,186 B2
(45) Date of Patent: Aug. 10, 2021

(54) THERMAL-INSULATED EXTERIOR WALL BOARDS, DEDICATED MOLDS AND MAKING METHODS THEREOF

(71) Applicant: SHANDONG UNIVERSITY, Shandong (CN)

(72) Inventors: Hetao Hou, Jinan (CN); Ning Wang, Jinan (CN); Haiyang Li, Jinan (CN); Bing Sun, Jinan (CN); Kefan Ji, Jinan (CN); Jianliang Luo, Jinan (CN)

(73) Assignee: SHANDONG UNIVERSITY, Jinan (CN)

( * ) Notice: Subject to any disclaimer, the term of this patent is extended or adjusted under 35 U.S.C. 154(b) by 0 days.

(21) Appl. No.: 16/489,941

(22) PCT Filed: Jun. 26, 2018

(86) PCT No.: PCT/CN2018/092746
§ 371 (c)(1),
(2) Date: Aug. 29, 2019

(87) PCT Pub. No.: WO2019/007224
PCT Pub. Date: Jan. 10, 2019

(65) Prior Publication Data

US 2020/0240144 A1 Jul. 30, 2020

(30) Foreign Application Priority Data

Jul. 4, 2017 (CN) ..... 201710536088.2
Jul. 4, 2017 (CN) ..... 201710536107.1
(Continued)

(51) Int. Cl.
*E04C 2/288* (2006.01)
*B28B 1/14* (2006.01)
(Continued)

(52) U.S. Cl.
CPC ..... *E04C 2/288* (2013.01); *B28B 1/14* (2013.01); *B28B 7/243* (2013.01); *B28B 23/04* (2013.01)

(58) Field of Classification Search
CPC ..... E04B 1/167
See application file for complete search history.

(56) References Cited

U.S. PATENT DOCUMENTS 3,879,908 A * 4/1975 Weismann
4,611,450 A * 9/1986 Chen
(Continued)

FOREIGN PATENT DOCUMENTS

CN 2515308 Y 10/2002
CN 101629440 A 1/2010
(Continued)

OTHER PUBLICATIONS

Aug. 29, 2018 Search Report issued in International Patent Application No. PCT/CN2018/092746.
(Continued)

*Primary Examiner* — Babajide A Demuren
(74) *Attorney, Agent, or Firm* — Oliff PLC

(57) ABSTRACT

A prefabricated prestressed thermal-insulated exterior wall board and a light weight composite thermal-insulated exterior wall board include a thermal-insulated core board, a reinforcement mesh on both sides of the thermal-insulated core board, and a concrete layer cast on the reinforcement mesh, and the thermal-insulated core board includes a plurality of throughout-length thermal-insulated core board ribs, and the concrete layer includes a plurality of concrete ribs interlaced with and matching the thermal-insulated core board ribs, a shear-resistant connection members connected with the reinforcement mesh is inserted between the adjacent thermal-insulated core board ribs, and prestressed ten-
(Continued)

dons are disposed in grooves formed between the adjacent thermal-insulated core board ribs and grooves formed between the adjacent concrete ribs in the prefabricated prestressed thermal-insulated exterior wall board.

15 Claims, 8 Drawing Sheets

(30) Foreign Application Priority Data

Jul. 4, 2017 (CN) ..... 201720797272.8
Jul. 4, 2017 (CN) ..... 201720797273.2

(51) Int. Cl.
*B28B 7/24* (2006.01)
*B28B 23/04* (2006.01)

(56) References Cited

U.S. PATENT DOCUMENTS

| | | | |
|---|---|---|---|
| 5,146,721 | A * | 9/1992 | Candiracci |
| 6,185,890 | B1 * | 2/2001 | Ritter |
| 6,226,942 | B1 * | 5/2001 | Bonin |
| 6,272,805 | B1 * | 8/2001 | Ritter et al. |
| 7,143,559 | B1 * | 12/2006 | Ritter |
| 2002/0043045 | A1 * | 4/2002 | Marino Del Din |
| 2004/0065034 | A1 * | 4/2004 | Messenger et al. |
| 2010/0107536 | A1 * | 5/2010 | Tautari et al. |
| 2011/0036031 | A1 * | 2/2011 | Candiracci |
| 2011/0061329 | A1 * | 3/2011 | Tadros et al. |
| 2012/0073227 | A1 * | 3/2012 | Urusoglu |
| 2013/0266793 | A1 * | 10/2013 | Robertshaw |
| 2015/0322664 | A1 * | 11/2015 | Manning |

FOREIGN PATENT DOCUMENTS

| | | | | |
|---|---|---|---|---|
| CN | 201385367 | Y | 1/2010 | |
| CN | 103465344 | A | 12/2013 | |
| CN | 105735553 | A | 7/2016 | |
| CN | 106760143 | A | 5/2017 | |
| CN | 107288256 | A | 10/2017 | |
| CN | 107322768 | A | 11/2017 | |
| CN | 206953253 | U | 2/2018 | |
| CN | 206957042 | U | 2/2018 | |
| DE | 10341761 | A1 * | 4/2005 | |
| EP | 1106745 | A2 * | 6/2001 | ..... E04C 2/06 |
| JP | 2009-263877 | A | 11/2009 | |

OTHER PUBLICATIONS

Aug. 29, 2018 Written Opinion of the International Searching Authority issued in Interational Patent Application No. PCT/CN2018/092746.

* cited by examiner

THERMAL-INSULATED EXTERIOR WALL BOARDS, DEDICATED MOLDS AND MAKING METHODS THEREOF

FIELD OF THE INVENTION

The present invention relates to the field of building steel structures, in particular to a lightweight composite thermal-insulated exterior wall board, a prefabricated prestressed thermal-insulated exterior wall board, dedicated molds for making the prestressed thermal-insulated exterior wall board and the lightweight composite thermal-insulated exterior wall board and making methods thereof.

BACKGROUND OF THE INVENTION

With the increase of population, the shortage of resources has become more and more serious, and the concepts of energy conservation and environmental protection have been deeply rooted in the hearts of the people. Building energy consumption accounts for a large proportion of social energy consumption, and it accounts for 50% of the total carbon dioxide emissions of the whole society. Therefore, building energy conservation is imperative. The energy saving of the green steel building systems can reach more than 65%, and the supported wall board enclosing system is particularly important.

Composite exterior wall boards are mainly used in steel structure buildings and concrete structure buildings. At present, prefabricated composite exterior wall boards with thermal-insulated layers are mainly made of extruded polystyrene (XPS), expanded polystyrene (EPS) boards and other organic materials as insulation sandwich layers, with both sides of reinforced concrete panels with equal thickness, which constitute a composite thermal-insulated exterior wall board by a certain type of connection member.

Due to the requirements of fireproofing and stress performance of the exterior wall board, the thickness of the reinforced concrete panel on both sides of the traditional composite exterior wall board should not be too thin (>50 mm), so that the composite exterior wall board have a large self-weight, which increases the load and seismic force of the structure and thus has no advantages to seismic performance, and increases production, transportation and installation costs; under the action of high-rise wind loads and dynamic loads in the hoisting process, it is easy to produce cracks which affect the product quality.

At present, the production of composite exterior wall boards is mainly based on flat die production. The flat die production occupies a large area of the die table and the production efficiency is low. However, the common vertical die machine template has small rigidity and cannot be used for producing large concrete wallboards.

SUMMARY OF THE INVENTION

In order to solve the technical problems existing in the prior art, the invention provides a thermal-insulated exterior wall boards which have light weight, high rigidity and can improve the energy-saving effect thereof, dedicated molds, and making methods thereof.

A first object of the invention is to provide a lightweight composite thermal-insulated exterior wall board.

A second object of the invention is to provide a prefabricated prestressed thermal-insulated exterior wall board.

A third object of the invention is to provide a mold for making the lightweight composite thermal-insulated exterior wall board.

A fourth object of the invention is to provide a mold for making the prefabricated prestressed thermal-insulated exterior wall board.

A fifth object of the invention is to provide a method for making the lightweight composite thermal-insulated exterior wall board.

A sixth object of the invention is to provide a method for making the prefabricated prestressed thermal-insulated exterior wall board.

In order to solve the above technical problem, the invention provides the following technical solutions:

The invention provides a lightweight composite thermal-insulated exterior wall board, comprising a thermal-insulated core board, a reinforcement mesh on both sides of the thermal-insulated core board, and a concrete layer cast on the reinforcement mesh, wherein the thermal-insulated core board is provided with a plurality of throughout-length thermal-insulated core board ribs, and the concrete layer is provided with a plurality of concrete ribs interlaced with and matching the thermal-insulated core board ribs, and a shear-resistant connection member connected with the reinforcement mesh is inserted between the adjacent thermal-insulated core board ribs.

The invention provides a prefabricated prestressed thermal-insulated exterior wall board, comprising the above-mentioned lightweight composite thermal-insulated exterior wall board, and prestressed tendons which are provided in grooves formed between the adjacent thermal-insulated core board ribs of the lightweight composite thermal-insulated exterior wall and/or grooves formed between the adjacent concrete ribs.

Further, in the above-mentioned lightweight composite thermal-insulated exterior wall board and the prefabricated prestressed thermal-insulated exterior wall board, the prestressed tendons are consolidated in the centroid area of the concrete rib.

In the above-mentioned lightweight composite thermal-insulated exterior wall board and the prefabricated prestressed thermal-insulated exterior wall board, the cross sections of the thermal-insulated core board rib and the concrete rib are trapezoidal, zigzag or wavy.

Further, in the above-mentioned lightweight composite thermal-insulated exterior wall board and the prefabricated prestressed thermal-insulated exterior wall board, the thermal-insulated core board is made of a thermal-insulated material such as XPS, EPS, polystyrene granular mortar, rock wool, glass wool, phenolic boards or polyurethane. The concrete layer is made of lightweight aggregate concrete.

Further, in the above-mentioned lightweight composite thermal-insulated exterior wall board and the prefabricated prestressed thermal-insulated exterior wall board, the angle between the shear-resistant connection member and the horizontal plane of the thermal-insulated core board is 30° to 900°.

Further, in the above-mentioned lightweight composite thermal-insulated exterior wall board and the prefabricated prestressed thermal-insulated exterior wall board, rabbets are provided around the outside of the concrete layer.

Further, the lightweight composite thermal-insulated exterior wall board is provided with door or window openings, and reinforcing tendons are disposed around the door or window openings.

The invention also provides a dedicated mold for making the above-mentioned lightweight composite thermal-insulated exterior wall board, comprising a bottom template, two mutually parallel end templates and two mutually parallel vertical templates, the vertical template and the end template respectively connected with the four sides of the bottom template.

Further, in the dedicated mold for making the above-mentioned lightweight composite thermal-insulated exterior wall board, a plurality of partitions connected with the bottom template are disposed between the two vertical templates, and grooves are provided in the two ends of the partition corresponding to the end template, and convexes that match the grooves are provided in an inner side wall of the end template.

Further, in the dedicated mold for making the above-mentioned lightweight composite thermal-insulated exterior wall board, the two sides of the vertical template are provided with brackets for preventing deformation and toppling of the dedicated mold.

The method for making the above-mentioned lightweight composite thermal-insulated exterior wall board by using the above dedicated mold comprises:

step 1: calculating parameters: according to the actual project requirements, by comprehensively considering the service conditions including wind loads, seismic actions and temperature stress loads, calculating and determining the size of the thermal-insulated core board and the concrete layer, and determining the cross-section forms of the thermal-insulated core board rib and the concrete rib;

step 2: making a thermal-insulated core board: according to the calculated size of the thermal-insulated core board and the cross-section form of the thermal-insulated core board rib, making a thermal-insulated material into the thermal-insulated core board or customizing the thermal-insulated core board in factories;

step 3: binding the reinforcement mesh truss core board: inserting the shear-resistant connection member between the adjacent thermal-insulated core board ribs, and determining a distance between the reinforcement mesh and the thermal-insulated core board, and then connecting the reinforcement mesh with the shear-resistant connection member to form a reinforcement mesh truss core board;

step 4: disposing the bottom template, the end template on one side, and the vertical template on one side: firstly disposing the bottom template, and then fixing one vertical template and one end template respectively to two mutually perpendicular sides of the bottom template;

step 5: positioning the reinforcement mesh truss core board: firstly placing the reinforcement mesh truss core board sidewise into the bottom template and the vertical template that have been fixed, and arranging the thermal-insulated core board ribs vertically, and then controlling the distance between the reinforcement mesh truss core board and the vertical template according to the thickness of the concrete layer;

step 6: disposing the vertical template and the end template on the other side: fixing another vertical template on the bottom template, and under the premise of ensuring that the net sizes in the dedicated mold are respectively the thickness, height, and width of the lightweight composite thermal-insulated exterior wall board, and finally fixing the other end template to the bottom template;

step 7: pouring the concrete layer: pouring the concrete from top to bottom above the dedicated mold, and after pouring, levelling the surface of the concrete layer, and then curing;

step 8: demolding: after the concrete reaches the expected strength, demolding the lightweight composite thermal-insulated exterior wall board.

Further, when a plurality of lightweight composite thermal-insulated exterior wall boards are simultaneously cast using the dedicated mold, in step 5, the reinforcement mesh truss core boards and the partitions are placed side by side into the bottom template and the vertical template that have already been fixed, and the thermal-insulated core ribs are arranged vertically, so that the grooves of the partitions match the convexes of the end template until all the reinforcement mesh truss core boards and the partitions are placed.

The invention also provides a dedicated mold for making the prefabricated prestressed thermal-insulated exterior wall board, comprising a template body and a tensioning device, wherein:

the template body comprises a bottom template, two side templates and two end templates, wherein the two side templates are respectively connected with two long sides of the bottom template, the two end templates are respectively connected with two short sides of the bottom template and two side templates, and each end template is provided with through-holes for passage of the prestressed tendons;

the tensioning device includes a fixing part at one end of the template body for fixing the prestressed tendons and a prestressed tensioning part at the other end of the template body for tensioning the prestressed tendons.

Further, in the dedicated mold for making the prefabricated prestressed thermal-insulated exterior wall board, the cavity of the template body is provided with a plurality of middle partitions, the middle partitions are embedded and fixed between the two side templates, and the middle partitions are provided with through-holes for passage of the prestressed tendons.

Further, in the dedicated mold for making the prefabricated prestressed thermal-insulated exterior wall board, the fixing part is a first side abutment, and the first side abutment and the prestressed tendons are fixed by an anchor. The prestressed tensioning part includes a second side abutment, and the second side abutment is provided with a steel beam movable along the length direction of the prestressed tendons and a driving tensioning device for moving the steel beam, and the second side abutment and the steel beam are both provided with anchors for fixing the prestressed tendons.

Further, in the dedicated mold for making the prefabricated prestressed thermal-insulated exterior wall board, the second side abutment is a trapezoidal bracket having an open slot in the middle, the steel beam and the driving tensioning device are disposed in the open slot, the upper end and the lower end of the open slot are provided with rails for moving the steel beam, and the open slots on both sides of the steel beam are provided with a guard plate for ensuring the moving direction of the steel beam.

Further, in the dedicated mold for making the prefabricated prestressed thermal-insulated exterior wall board, the driving tensioning device is a jack or lifting device fixed on the side wall of the open slot.

The method for making the prefabricated prestressed thermal-insulated exterior wall board by using the above dedicated mold comprises:

step 1: calculating parameter: according to the actual project requirements, by comprehensively considering the service conditions including wind loads, seismic actions and temperature stress loads, calculating and determining the size of the thermal-insulated core board and the concrete layer, and determining the cross-section forms of the thermal-insulated core board rib and the concrete rib, the spacing between the reinforcement meshes, and the tension control stress and number of the prestressed tendons;

step 2: making a thermal-insulated core board: according to the calculated size of the thermal-insulated core board and the cross-section form of the thermal-insulated core board rib, making a thermal-insulated material into the thermal-insulated core board or customizing the thermal-insulated core board in factories;

step 3: binding the reinforcement mesh truss core board: inserting the shear-resistant connection member between the adjacent thermal-insulated core board ribs, determining a distance between the reinforcement mesh and the thermal-insulated core board, then connecting the reinforcement mesh with the shear-resistant connection member, and then providing the prestressed tendons in grooves formed between the adjacent thermal-insulated core board ribs and grooves formed between the adjacent concrete ribs to form a reinforcement mesh framework;

step 4: positioning the supporting template and the reinforcement mesh framework: firstly, placing the reinforcement mesh framework sidewise into a cavity formed by connecting the bottom template and the side template that have already been fixed, controlling the distance between the reinforcement mesh framework and the template body according to the thickness of the concrete layer, then enabling the prestressed tendons to pass through the end templates of the two ends, and fixing the end templates of the two ends to the two short sides of the bottom template and the two side templates respectively;

step 5: arranging the prestressed tendons and the tensioning device: firstly fixing the prestressed tendons extending from the end template at one end to the fixing part, and then fixing the prestressed tendons extending from the end template at the other end to the steel beam, and then tensioning the prestressed tendons by moving the steel beam; unloading to a calculated tension control stress after maintaining the load for a certain time, and fixing the prestressed tendons to the prestressed tensioning part;

step 6: pouring the concrete layer: pouring the concrete from top to bottom above the template body, and after pouring, leveling the surface of the concrete layer, and then curing;

step 7: releasing the prestressed tendons: after the strength of the concrete to be poured reaches 70 to 75% of the expected strength, releasing the prestressed tendons;

step 8: demolding: after the concrete reaches the expected strength, demolding the prefabricated prestressed thermal-insulated exterior wall board.

Further, in step 5, when the prestressed tendons are tensioned, the tension control stress needs to exceed 5% of the calculated tension control stress.

The invention has the following beneficial effects:

1. Compared with the prior art, the lightweight composite thermal-insulated exterior wall board and the prefabricated prestressed thermal-insulated exterior wall board of the invention adopt a combination of a ribbed thermal-insulated core board, a reinforcement mesh and a ribbed concrete layer. The concrete ribs for wrapping are only provided on the part of the shear-resistant connection member, and the remaining parts are filled with the thermal-insulated core board. Under the premise of ensuring the strength of the thermal-insulated exterior wall board, the self-weight of the exterior wall board is reduced, the thermal-insulated effect is increased, and the transportation cost is saved.

2. The prestressed tendons are provided in the grooves formed between the adjacent thermal-insulated core board ribs of the prefabricated prestressed thermal-insulated exterior wall board of the invention and/or the grooves formed between the adjacent concrete ribs; cracking of the exterior wall board under temperature stress, wind load and earthquake load is prevented.

3. Since the thermal-insulated core board and the concrete layer are provided with ribs, in the case that the lightweight composite thermal-insulated exterior wall board of the invention and the non-ribbed thermal-insulated exterior wall board (that is, the thermal-insulated exterior wall board with uniform thickness) have substantially the same bending rigidity and bearing capacity, the concrete used in the lightweight composite thermal-insulated exterior wall board of the invention reduced by about 20-40% compared with the non-ribbed thermal-insulated exterior wall board, and the energy saving effect is improved by about 5-20%.

4. The prestressed tendons are provided in grooves formed between the adjacent thermal-insulated core board ribs and/or grooves formed between the adjacent concrete ribs for the prefabricated prestressed thermal-insulated exterior wall board of the invention, so that the prestress can be effectively transmitted to the cross section of the entire concrete layer, and the concrete layers on both sides of the thermal-insulated core board are symmetrically arranged, so that the concrete is always in a stressed state, which increases the rigidity of the prefabricated prestressed thermal-insulated exterior wall board and reduces the possibility of crack generation;

5. The prefabricated prestressed thermal-insulated exterior wall board of the invention can be fully prefabricated and processed in the factory, and only needs to be bolted by embedded components at the construction site, which is convenient to disassemble and assemble, and reduces welding operation and environmental pollution on the site, and also improves the construction efficiency, and is benefit to the development of industrialization of buildings.

BRIEF DESCRIPTIONS OF THE DRAWINGS

DETAILED DESCRIPTION OF THE EMBODIMENTS

Figure 1:
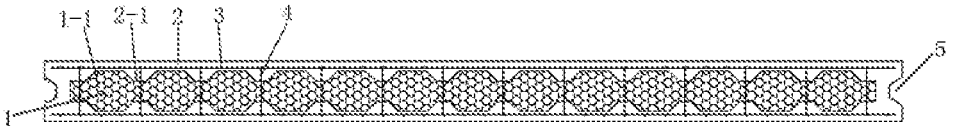
FIG. 1 is a transverse section view of a lightweight composite thermal-insulated exterior wall board of the invention, wherein the cross section of the thermal-insulated core board rib is trapezoidal.

It should be noted that the following detailed description is illustrative and is intended to provide a further description of the application. All technical and scientific terms used herein have the same meaning as commonly understood by one of ordinary skill in the art to which this invention belongs, unless otherwise indicated.

It should be noted that the terms used herein are merely for the purpose of describing specific embodiments, but are not intended to limit the exemplary embodiments. As used herein, the singular forms also are intended to include the plural forms, unless the context otherwise clearly indicates. Furthermore, it will also be understood that when the term "comprise" and/or "include" is used in the specification, it indicates the presence of features, steps, operations, devices, components, and/or combinations thereof.

For the convenience of description, if the words "upper", "lower", "left" and "right" appear in the invention, they only indicate the upper, lower, left and right directions of the drawing itself, and do not limit the structure. They are merely for the purpose of the convenience of the description of the present invention and the simplification of the description, but not intended to indicate or imply that the device or component referred to must have a specific orientation and is constructed and operated in a specific orientation, and thus should not be construed as limiting the present invention.

The lightweight composite thermal-insulated exterior wall board and the making mold and the making method thereof are respectively introduced in Embodiment 1. In Embodiment 2, the prefabricated prestressed thermal-insulated exterior wall board, the making mold and the making method thereof are respectively introduced.

Embodiment 1

The invention provides a lightweight composite thermal-insulated exterior wall board, as shown in FIG. 1 to FIG. 5, comprising a thermal-insulated core board 1, a reinforcement mesh 3 on both sides of the thermal-insulated core board 1, and a concrete layer 2 cast on the reinforcement mesh 3. The thermal-insulated core board 1 is provided with a plurality of throughout-length thermal-insulated core board ribs 1-1, the concrete layer 2 is provided with a plurality of concrete ribs 2-1 interlaced with and matching the thermal-insulated core board ribs 1-1, and a shear-resistant connection member 4 connected with the reinforcement mesh 3 is inserted between the adjacent thermal-insulated core board ribs 1-1.

The term "throughout-length" as used herein means that a plurality of thermal-insulated core board ribs 1-1 with the same length as the thermal-insulated core board 1 are disposed along the longitudinal direction of the thermal-insulated core board 1.

The spacing between a plurality of thermal-insulated core board ribs 1-1 are preferably equal, and may be unequal. Similarly, the spacing between the concrete ribs 2-1 is preferably equal, and may be unequal.

The lightweight composite thermal-insulated exterior wall board of the invention adopts a combination of a ribbed thermal-insulated core board, a reinforcement mesh and a ribbed concrete layer. The concrete ribs for wrapping are only provided on the part of the shear-resistant connection member, and the remaining parts are filled with the thermal-insulated core board. Under the premise of ensuring the strength of the thermal-insulated exterior wall board, the self-weight of the exterior wall board is reduced, the thermal-insulated effect is increased, and the transportation cost is saved. Moreover, since the thermal-insulated core board and the concrete layer are provided with ribs, in the case that the lightweight composite thermal-insulated exterior wall board of the invention and the non-ribbed thermal-insulated exterior wall board (that is, the thermal-insulated exterior wall board with uniform thickness) have substantially the same bending rigidity and bearing capacity, the lightweight composite thermal-insulated exterior wall board of the invention has a concrete reduction of about 20-40% compared with the non-ribbed thermal-insulated exterior wall board, and the energy saving effect is improved by about 5-20%.

Figure 2:
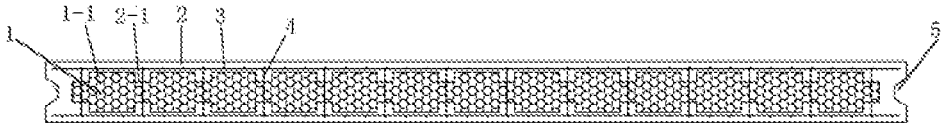
FIG. 2 is a transverse section view of a lightweight composite thermal-insulated exterior wall board of the invention, wherein the cross section of the thermal-insulated core board rib is zigzag.
Figure 3:
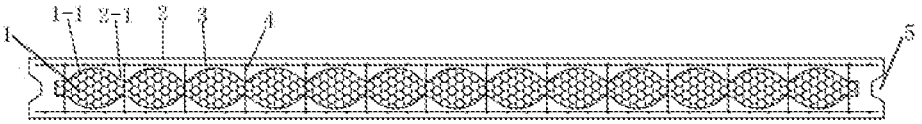
FIG. 3 is a transverse section view of a lightweight composite thermal-insulated exterior wall board of the invention, wherein the cross section of the thermal-insulated core board is wavy.

Preferably, the cross sections of the thermal-insulated core board rib 1-1 and the concrete rib 2-1 may be trapezoidal, as shown in FIG. 1; or may be zigzag, as shown in FIG. 2; or may be wavy, as shown in FIG. 3.

In order to increase the thermal-insulated performance of the lightweight composite thermal-insulated exterior wall board of the invention and reduce its weight, the thermal-insulated core board 1 is preferably made of a thermal-insulated material such as XPS, EPS, polyphenylene granule mortar, rock wool, glass wool, phenolic boards or polyurethane. The concrete layer 2 is preferably made of lightweight aggregate concrete.

Figure 4:
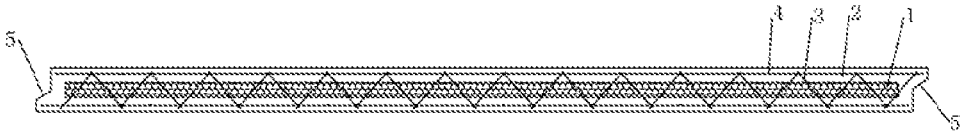
FIG. 4 is a longitudinal section view of a lightweight composite thermal-insulated exterior wall board of the invention, wherein the angle between the shear-resistant connection member and the horizontal plane of the thermal-insulated core board is 45°.

Further, the angle between the shear-resistant connection member 4 and the horizontal plane of the thermal-insulated core board 1 is preferably 30 to 900. Within this angle range, it is ensured that the shear-resistant connection member 4 acts as a shearing force in the lightweight composite thermal-insulated exterior wall board of the invention. FIG. 4 is the structural schematic view of the exterior wall board when the angle between the shear-resistant connection member 4 and the horizontal plane of the thermal-insulated core board 1 is 45°, and FIGS. 1 to 3 are the structural schematic views of the exterior wall board when the angle between the shear-resistant connection member 4 and the horizontal plane of the thermal-insulated core board 1 is 90°.

Figure 5:
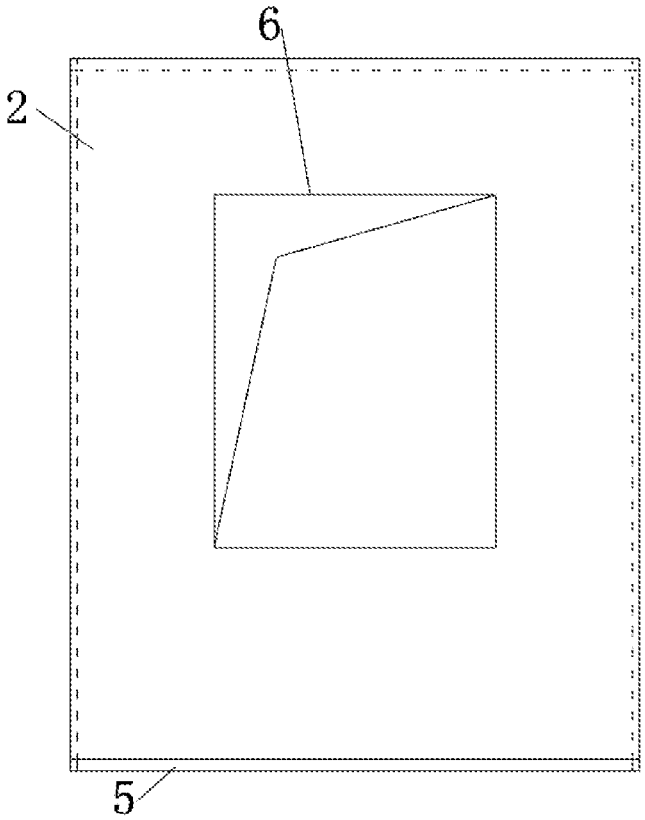
FIG. 5 is a schematic view of the exterior structure of the lightweight composite thermal-insulated exterior wall board of the invention.

In order to make the lightweight composite thermal-insulated exterior wall board of the invention suitable for different building positions, the lightweight composite thermal-insulated exterior wall board 1 may be provided with door or window openings to facilitate the installation of the door or window, and in addition, the reinforcing tendons are provided around the door or window openings to ensure the firmness of the exterior wall board. FIG. 5 is a structural schematic view of a lightweight composite thermal-insulated exterior wall board with a window opening 6.

In order to facilitate the installation of the exterior wall board and the post-waterproof construction measures, rabbets 5 are provided around the outside of the concrete layer. The left and right rabbets on the outside of the concrete layer are concave rabbets, as shown in FIG. 1 to FIG. 3, the upper and lower rabbets of the concrete layer are respectively of water retaining and dripping structures, as shown in FIG. 4. The water retaining structure and the water dripping structure are protrusions provided on the upper and lower edges of the lightweight composite exterior wall board, and the protrusions of the upper edge are symmetrical with the protrusions of the lower edge.

Figure 6:
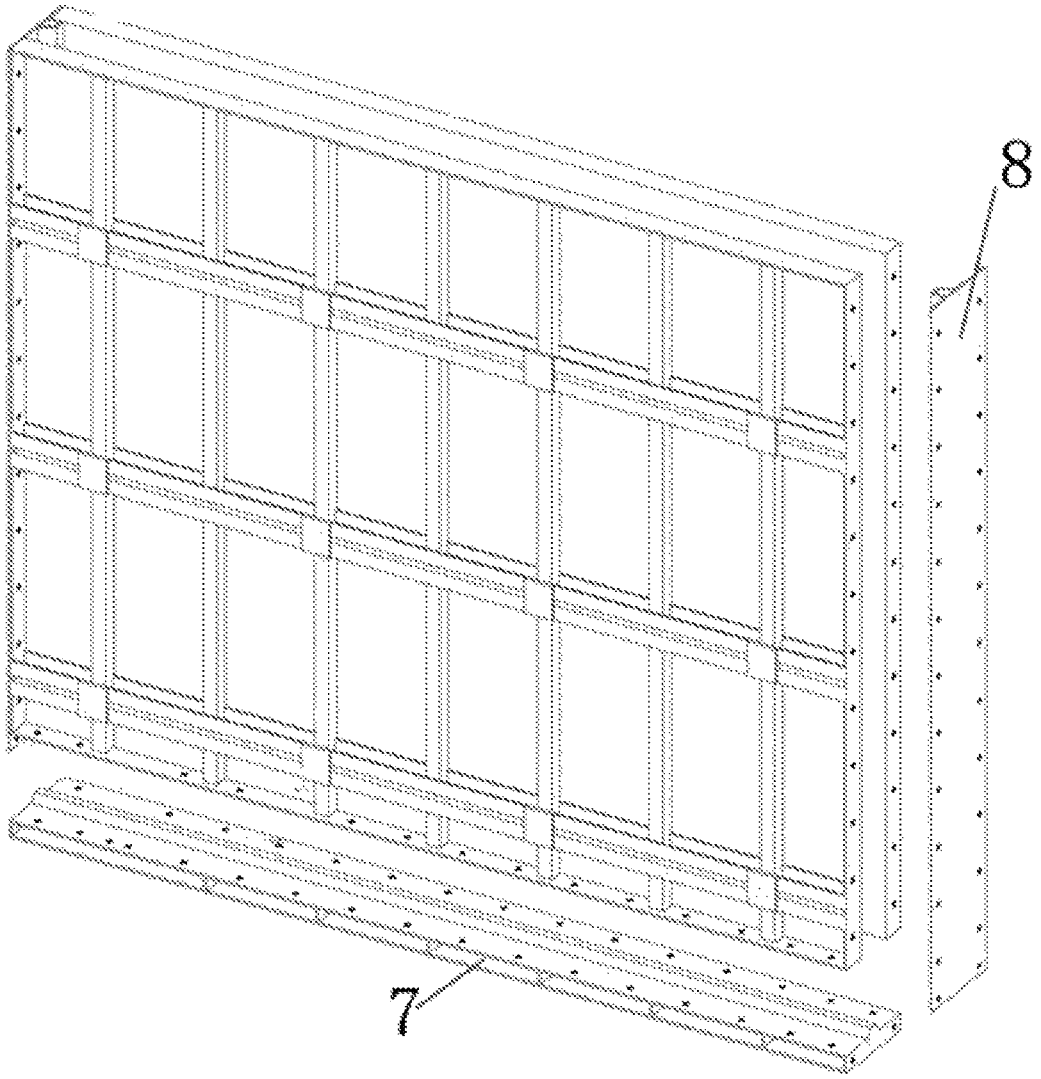
FIG. 6 is a structural schematic view of a dedicated mold of the invention.
Figure 7:
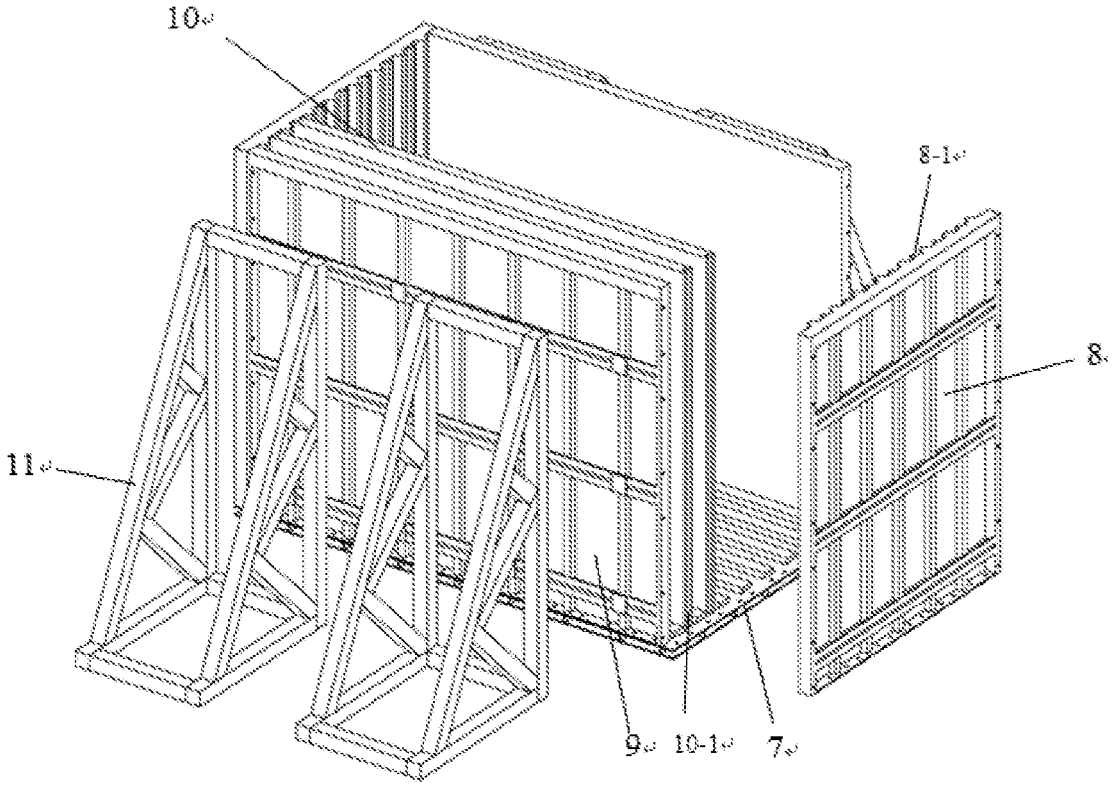
FIG. 7 is a structural schematic view of a plurality of lightweight composite thermal-insulated exterior wall boards of the invention made using the dedicated mold of the invention.
Figure 8:
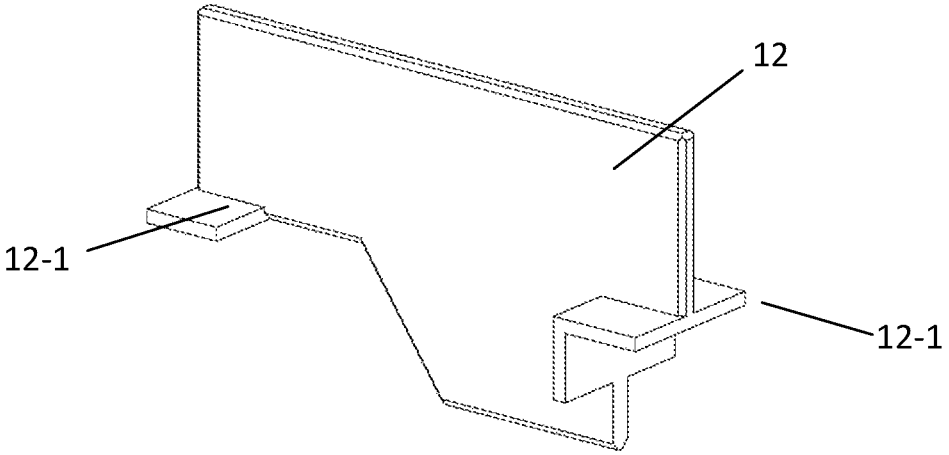
FIG. 8 is a structural schematic view of rabbet forming tool for the upper rabbets of the lightweight composite heat-insulated exterior wall of the invention.
Figure 9:
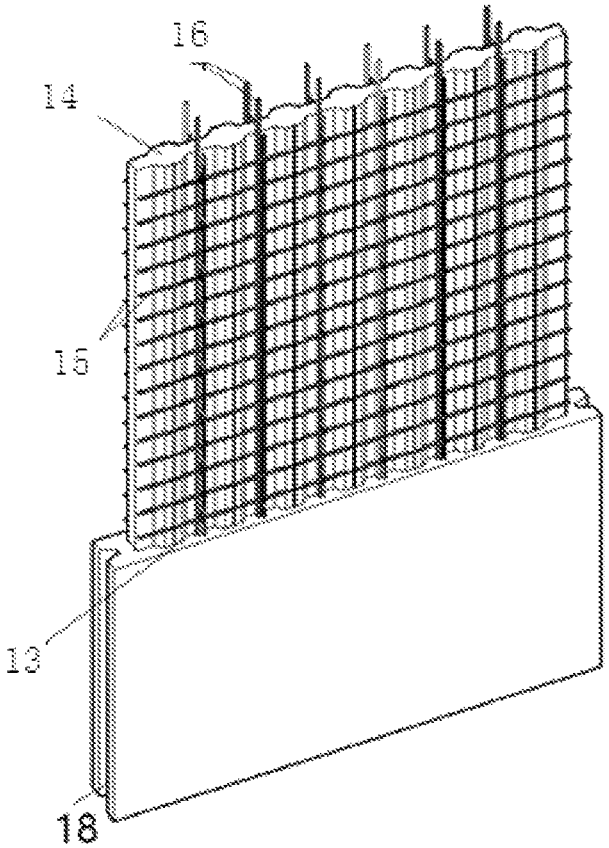
FIG. 9 is a section view of a prefabricated prestressed thermal-insulated exterior wall board of the invention.
Figure 10:
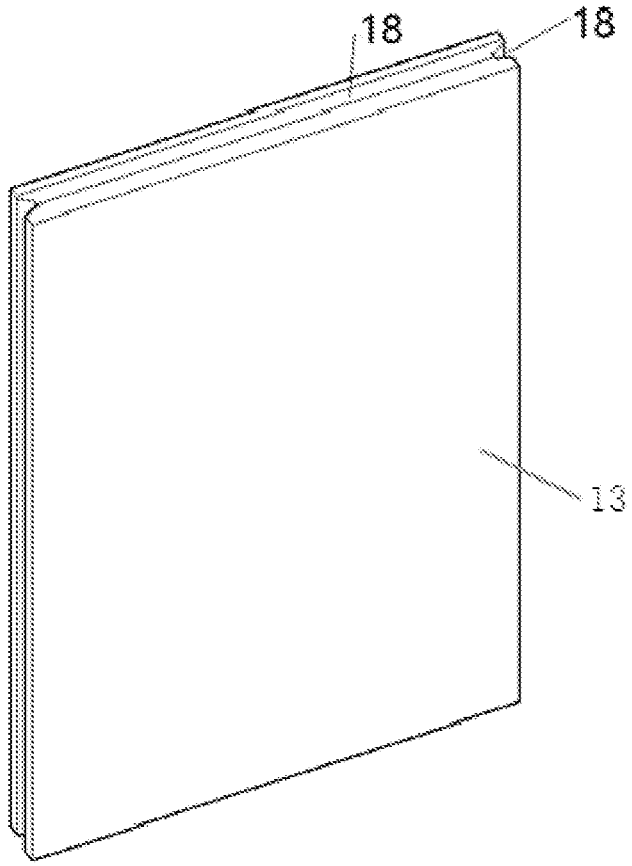
FIG. 10 is the overall structure schematic view of a prefabricated prestressed thermal-insulated exterior wall board of the invention.
Figure 11:
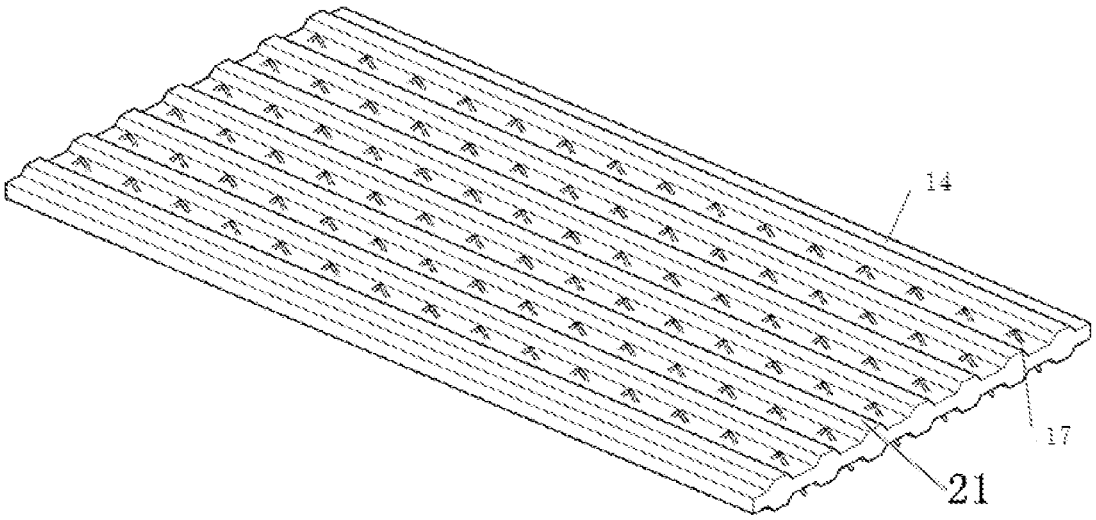
FIG. 11 is a structural schematic view of a thermal-insulated core board of a prefabricated prestressed thermal-insulated exterior wall board of the invention, wherein a cross section of the rib of the thermal-insulated core board is trapezoidal.
Figure 12:
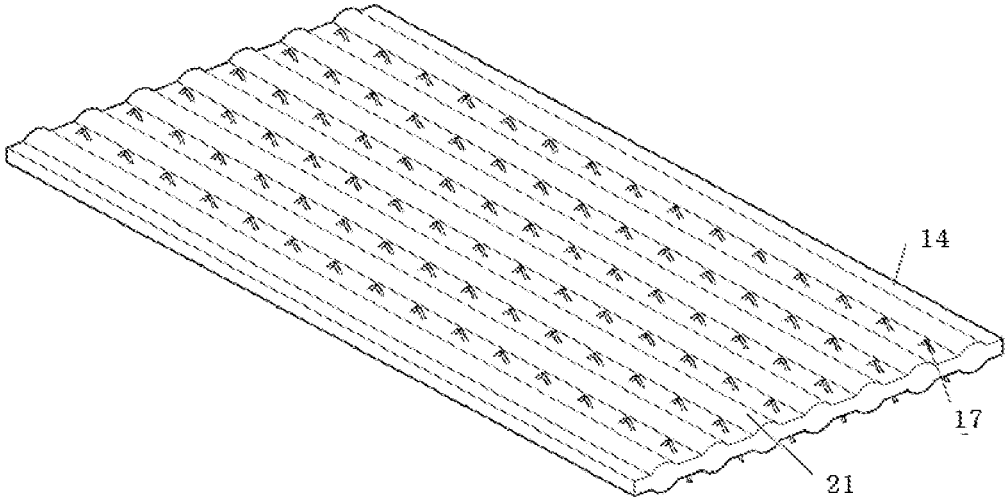
FIG. 12 is a structural schematic view of a thermal-insulated core board of a prefabricated prestressed thermal-insulated exterior wall board of the invention, wherein a cross section of the rib of the thermal-insulated core board is wavy.
Figure 13:
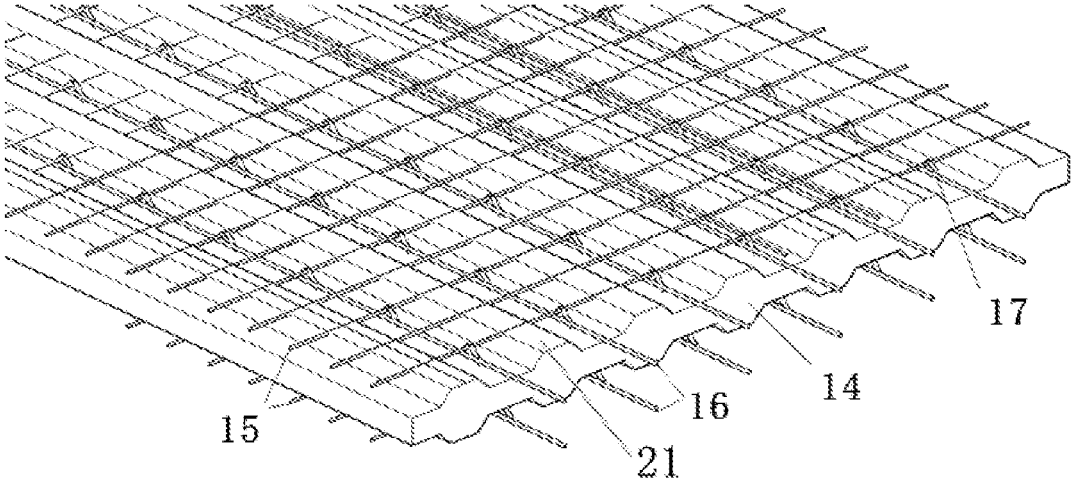
FIG. 13 is a structural schematic view of a prefabricated prestressed thermal-insulated exterior wall board in which a concrete layer is removed.
Figure 14:
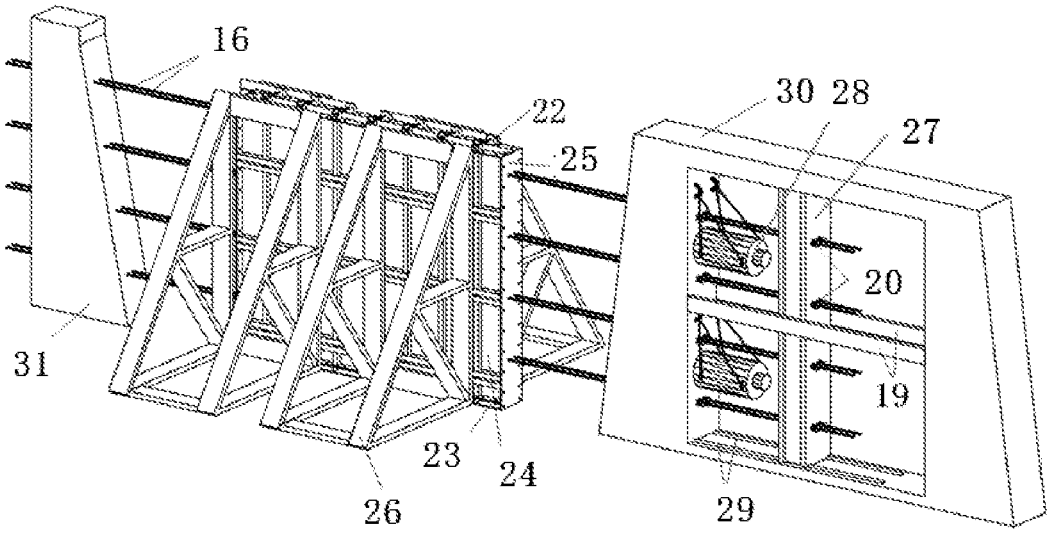
FIG. 14 is a structural schematic view of a dedicated mold of the invention.
Figure 15:
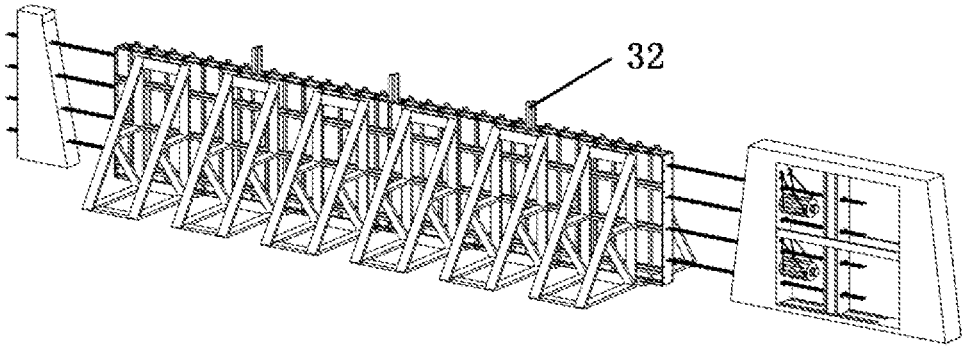
FIG. 15 is a structural schematic view of a plurality of prefabricated prestressed thermal-insulated exterior wall boards of the invention simultaneously made by using the dedicated mold of the invention.

The invention also provides a dedicated mold for making the above-mentioned lightweight composite thermal-insulated exterior wall board, as shown in FIG. 6 to FIG. 8, comprising a bottom template 7, two mutually parallel end templates 8 and two mutually parallel vertical templates 9. The vertical templates 9 and the end templates 8 are respectively connected with the four sides of the bottom template 7.

The dedicated mold of the invention adopts three-dimensional placement, and the concrete is poured to the lightweight composite thermal-insulated exterior wall board of the invention from the top, which can ensure that the concrete fills the gaps of the thermal-insulated core board ribs, and occupies less space, so that the original limited production workshop is fully utilized.

As a modification of the invention, a plurality of partitions 10 connected with the bottom template 7 are preferably disposed between the two vertical templates 9, and the ends of the partitions 10 corresponding to the end templates 8 are provided with grooves 10-1, and the inner side wall of the end template 8 is provided with convexes 8-1 that match the grooves 10-1. The arrangement of the partition 10 enables the dedicated mold of the invention to simultaneously cast a plurality of lightweight composite thermal-insulated exterior wall boards of the invention, and the production efficiency is greatly improved, provided that the occupied space is small.

In addition, when pouring the lightweight composite thermal-insulated exterior wall board, in order to simultaneously cast the rabbets around the lightweight composite thermal-insulated exterior wall board, a trapezoidal molding strip capable of forming a lower rabbet of the lightweight composite thermal-insulated wallboard can be disposed on the bottom template 7; a trapezoidal molding strip capable of forming left and right rabbets of a lightweight composite thermal-insulated wall board can be disposed on the end template 8.

The upper rabbet of the lightweight composite thermal-insulated exterior wall board can be used in the process of pouring the lightweight composite thermal-insulated exterior wall board, and after the initial setting of the concrete, the upper rabbet forming tool 12 is used to scrape the excess concrete to form the upper rabbet of the lightweight composite thermal-insulated exterior wall board. The structure of the upper rabbet forming tool 12 is as shown in FIG. 8.

Further, in order to ensure the stability when the exterior wall board is cast using the dedicated mold of the invention, and to prevent the vertical template from deformation and toppling, both sides of the vertical template 9 are preferably provided with a bracket 11.

The invention also provides a method for making the above-mentioned lightweight composite thermal-insulated exterior wall board by using the above-mentioned dedicated mold, comprising:

step 1: calculating parameters: according to the actual project requirements, by comprehensively considering the service conditions including wind load, seismic action and temperature stress load, calculating and determining the size of the thermal-insulated core board 1 and the concrete layer 2, and determining the cross-section forms of the thermal-insulated core board rib 1-1 and the concrete rib 2-1;

step 2: making the thermal-insulated core board: according to the calculated size of the thermal-insulated core board 1 and the cross-section form of the thermal-insulated core board rib 1-1, making a thermal-insulated material into the thermal-insulated core board 1 or customizing the thermal-insulated core board from a factory;

step 3: binding the reinforcement mesh truss core board: inserting the shear-resistant connection member 4 between the adjacent thermal-insulated core board ribs 1-1, and determining a distance between the reinforcement mesh 3 and the thermal-insulated core board 1, and then connecting the reinforcement mesh 1 with the shear-resistant connection member 4 to form a reinforcement mesh truss core board;

step 4: disposing the bottom template, the end template on one side and the vertical template on one side: firstly disposing the bottom template 7, and then fixing one end template 8 and one vertical template 9 on the bottom template 7;

step 5: positioning the reinforcement mesh truss core board: firstly placing the reinforcement mesh truss core board sidewise placed into the bottom template 7 and the vertical template 9 that have already been fixed, and arranging the thermal-insulated core board ribs 1-1 vertically, and then controlling the distance between the reinforcement mesh truss core board and the vertical template 9 according to the thickness of the concrete layer 2;

wherein in this step, the vertically disposed thermal-insulated core board ribs 1-1 can cause the concrete to be poured more smoothly from top to bottom, so that the concrete layer after pouring is more compact. In addition, a modulus card strip can be used to control the distance between the reinforcement mesh truss core board and the vertical template 9, and the bottom template 7 and the end template 8 can be bolted respectively with the vertical template 9 as well as the bottom template 7 and the vertical template 9.

step 6: disposing the vertical template and the end template on the other side: fixing another vertical template 9 on the bottom template 7, and under the premise of ensuring that the net sizes in the dedicated mold are respectively thickness, height, and width of the lightweight composite thermal-insulated exterior wall board, the other end template 8 is finally fixed on the bottom template 7;

step 7: pouring the concrete layer: pouring the concrete from top to bottom above the dedicated mold, and after pouring, leveling the surface of the concrete layer, and then curing;

In this step, in order to ensure a compact concrete layer during the pouring process, self-compacting concrete is preferably used, and the vibrating rod may be used for the side vibrating during the pouring process.

When the upper rabbet forming tool 12 is used to make the upper rabbet of the lightweight composite heat-insulated exterior wall board after the initial setting of the concrete, the flap 12-1 on both sides of the upper rabbet forming tool 12 can be placed on the vertical template 9, after which the upper rabbet forming tool 12 is moved along the longitudinal direction of the vertical template 9 (namely the direction of the arrow in FIG. 7), whereby the upper rabbet (water-blocking structure) of the lightweight composite thermal-insulated exterior wall board can be molded.

Step 8: demolding: after the concrete reaches the expected strength, demolding the lightweight composite thermal-insulated exterior wall board.

After this step, the formed lightweight composite thermal-insulated exterior wall board can be transported to the corresponding location for storage.

The invention adopts the above dedicated mold to carry out three-dimensional pouring on the lightweight composite thermal-insulated exterior wall board, which can ensure that the concrete fills the gaps of the thermal-insulated core board ribs and the occupied space is small, so that the originally limited production workshop can be fully utilized.

Preferably, when a plurality of lightweight composite thermal-insulated exterior wall boards are simultaneously cast using the dedicated mold of the invention, in the above step 5, the reinforcement mesh truss core boards and the partitions 10 may be sequentially placed sidewise into the bottom template 7 and the vertical template 9 that have already been fixed, and the 9 thermal-insulated core board ribs 1-1 are arranged vertically, so that the groove 10-1 of the partition 10 matches the convex 8-1 of the end template 8 until all the reinforcement mesh truss core boards and the partitions 10 are placed.

When placing the reinforcement mesh truss core boards and partitions, the following principles should be followed: firstly the first reinforcement mesh truss core board is placed, then a partition 10 is placed between the reinforcement mesh truss core board and the vertical template 9, so that the first reinforcement mesh truss core board is placed between the vertical template 9 and the partition 10, and after the distance between the reinforcement mesh truss core board and the vertical template 9 and the distance between the reinforcement mesh truss core board and the partition 10 are controlled, another reinforcement mesh truss core board is placed, and then a partition 10 is placed until all the reinforcement mesh truss core boards and partitions are placed.

Further, in order to make the partition 10 more stably fixed in the dedicated mold of the invention, the grooves 10-1 of the partition 10 and the convexes 8-1 of the end template 8 are preferably in interference fit.

Further, in the above step 5, if the light composite thermal-insulated exterior wall board has door or window opening, the template of the door or window openings is placed along with the reinforcement mesh truss core board on the bottom template 7 and one side of the vertical template 9 that have already been fixed; if the lightweight composite thermal-insulated exterior wall board has embedded components or the pre-embedded casings, the embedded components or the pre-embedded casings are disposed at corresponding positions on the reinforcement mesh truss core board. The arrangement of the door, the window, the embedded components or the pre-embedded casings can make the applicable scope and position of the lightweight composite thermal-insulated exterior wall board of the invention wider, and the installation of the exterior wall board is more rapid, so that the welding work volume on the construction site is greatly reduced.

The inner two sides of the lightweight composite thermal-insulated exterior wall board of the invention are stiffened reinforced concrete panels, and in the case that the bending rigidity and the bearing capacity are substantially the same with those of the non-ribbed thermal-insulated exterior wall board (that is, the thermal-insulated exterior wall board with uniform thickness), the amount of concrete used is about 20%-40% less than that of then on-ribbed thermal-insulated exterior wall board; The thermal-insulated core board of the lightweight composite thermal-insulated exterior wall board of the invention is a ribbed thermal-insulated board, which has an energy saving effect of about 5-20% higher than that of the thermal-insulated board with same thickness.

When using a dedicated mold with more than two vertical templates for pouring, multiple thermal-insulated exterior wall boards can be poured simultaneously, which is more efficient and takes up less space than traditional flat pouring, so that the original limited production workshop is fully utilized.

The shear-resistant connection member described in the above Embodiment 1 may be a flexible connection member such as a diagonal reinforcement, a truss reinforcement, a reinforced glass fiber (GFRP) truss, a GFRP rod; or a rigid connection member such as an H-type steel beam, an H-type honeycomb steel beam, an H-type GFRP beam, an H-type GFRP honeycomb beam, a stainless steel connection member, a square steel connection member, a T-type connection member, and the like can be used.

Embodiment 2

In one aspect, the invention provides a prefabricated prestressed thermal-insulated exterior wall board, as shown in FIGS. 1 to 5, including a thermal-insulated core board 14, a reinforcement mesh 15 on both sides of the thermal-insulated core board 14, and the concrete layer 13 cast on the reinforcement mesh 15, and the thermal-insulated core board 14 is provided with a plurality of throughout-length thermal-insulated core board ribs 21, and the concrete layer 13 is provided with a plurality of concrete ribs interlaced with and matching the thermal-insulated core board ribs 21, and a shear-resistant connection member 17 connected with the reinforcement mesh 15 is inserted between the adjacent thermal-insulated core board ribs 21, and a prestressed tendon 16 is disposed in a groove formed between the adjacent thermal-insulated core board ribs 21.

The term "throughout-length" as used herein means that a plurality of thermal-insulated core board ribs 1-1 which have the same length as the thermal-insulated core board 1 are disposed along the longitudinal direction of the thermal-insulated core board 1.

The spacing between a plurality of thermal-insulated core board ribs 1-1 is preferably equal, and may be unequal. Similarly, the spacing between the concrete ribs 2-1 is preferably equal, and may be unequal.

The prefabricated prestressed thermal-insulated exterior wall board of the invention adopts a combination of a ribbed thermal-insulated core board 14, a reinforcement mesh 15 and a ribbed concrete layer 13. The concrete ribs for wrapping are only provided on the part of the shear-resistant connection member 17, and the remaining parts are filled with the thermal-insulated core board 14. Under the premise of ensuring the strength of the thermal-insulated exterior wall board, the self-weight of the exterior wall board is reduced, the thermal-insulated effect is increased, the transportation cost is saved, and the dynamic performance of the wall board under the wind load and the seismic load is reduced;

The prefabricated prestressed thermal-insulated exterior wall board of the invention is provided with prestressed tendons 16 in the grooves formed between the adjacent thermal-insulated core board ribs 21, which can effectively transmit the prestress to the entire concrete section, and the concrete layers 13 on both sides of the thermal-insulated core board 14 are symmetrically arranged, so that the concrete is always under pressure, which increases the rigidity of the prefabricated prestressed thermal-insulated exterior wall board and reduces the possibility of crack generation; The prefabricated prestressed thermal-insulated exterior wall board of the invention can be fully prefabricated and processed in the factory, and only needs to be bolted by embedded components at the construction site, which is convenient to disassemble and assemble, and reduces welding operation and environmental pollution on the site, and also improves the construction efficiency, and is benefit to the development of industrialization of buildings.

In the invention, the prestressed tendons 16 may be disposed in the grooves formed between the adjacent thermal-insulated core board ribs 21, or may be disposed in the grooves formed between the adjacent concrete ribs, or may be disposed simultaneously in the groove formed between the adjacent thermal-insulated core board ribs 21 and the groove formed between the adjacent concrete ribs, which can also achieve the technical solution of the invention and has the same expected effects.

In order to ensure that the prestress of the prestressed tendons 16 can be effectively transmitted to the cross section of the concrete layer to the maximum extent, the prestressed tendons 16 in the embodiment of the invention are preferably consolidated in the centroid area of the ribs of the concrete layer 13.

Of course, in addition to the above structure, with which the cracks of the prefabricated prestressed thermal-insulated exterior wall board of the invention can be reduced, other methods such as simply increasing or decreasing the number of prestressed tendons 16 and increasing the tension control stress of the prestressed tendons 16, and changing the prestressed tendons 16 to the steel strand can also achieve the purpose of reducing the crack of the prefabricated prestressed thermal-insulated exterior wall board of the invention.

Further, the cross section of the thermal-insulated core board rib 21 and the concrete rib may be trapezoidal, as shown in FIG. 3; or may be wavy, as shown in FIG. 4.

Further, the thermal-insulated core board 14 is made of a thermal-insulated material such as XPS, EPS, phenolic plate or polyphenylene granule mortar.

In order to facilitate the installation of the exterior wall board and the post-waterproof construction measures, rabbets 18 are preferably provided around the outside of the concrete layer 13.

Preferably, the angle between the shear-resistant connection member 17 and the horizontal plane of the thermal-insulated core board 14 may be 30° to 90°. In the embodiment of the invention, the angle between the shear-resistant connection member 17 and the horizontal plane of the thermal-insulated core board 14 is 45°, as shown in FIGS. 3 to 5. In the embodiment of the invention, the shear-resistant connection member 17 is inserted into the thermal-insulated core board 14 obliquely at an angle of 45°, and the shear-resistant connection member 17 can also be directly inserted or disposed at other angles to bear the shearing force.

In addition, the shear-resistant connection member 17 in the embodiment of the invention can also be directly inserted into the thermal-insulated core board 14 by using steel bars.

In another aspect, the invention provides a dedicated mold for making the above-described prefabricated prestressed thermal-insulated exterior wall board, as shown in FIGS. 6 and 7, including a template body and a tensioning device, wherein, the template body comprises a bottom template 23, two side templates 24 and two end templates 25, and the two side templates 24 are respectively connected with the two long sides of the bottom template 23, the two end templates 25 are respectively connected with the two short sides of the bottom template 23, and the end templates 25 are provided with through-holes for passage of the prestressed tendons 16; the tensioning device includes a fixing part for fixing the prestressed tendons 16 at one end of the template body and a prestressed tension portion for tensioning the prestressed tendons 16 at the other end of the template body.

The dedicated mold of the invention adopts the template body and the tensioning device stereoscopically placed, and can pour the concrete onto the prefabricated prestressed thermal-insulated exterior wall board of the invention from the upper part of the template body to ensure the compactness of the pouring; and the prestress is applied by the integral mechanical tensioning of the vertical molds, the position of the prestressed tensioning part is adjustable, and the prefabricated prestressed thermal-insulated exterior wall board of the invention can be produced in batch.

In order to simultaneously produce a plurality of prefabricated prestressed thermal-insulated exterior wall boards using the dedicated mold of the invention, a plurality of middle partitions 32 are preferably disposed in the cavity formed by the bottom template 23, the side templates 24 and the end templates 25, the middle partitions 32 are embedded between the two side templates 24, the middle partitions 32 are provided with through-holes for passage of the prestressed tendons 16. The position of the middle partition 32 can be determined based on the length of the prefabricated prestressed thermal-insulated exterior wall board produced.

Between the middle partitions 32 and the two side templates 24, the middle partitions 32 can be adsorbed on the inner side of the two side templates 24 by using a magnet. Of course, other connection methods that can be conceived by those skilled in the art and follow the above principles can also be used to fix the middle partitions 32 on the inner sides of the two side templates 24, which does not affect the realization of the technical solution of the invention.

In addition, the two side templates 24 can be fixed by a pull rod 22 which is disposed at the upper end of the side templates 24. While the pull rod 22 is used to ensure the distance between the two side templates 24, the positions of the two side templates 24 when pouring the concrete are unchanged to control the amount of deformation of the dedicated mold when pouring.

In order to prevent the bend and deformation of the dedicated mold, the two sides of the template body are preferably provided with brackets 26, and the brackets 26 on both sides are respectively placed on the two side templates 24.

As an improvement of the invention, the fixing part is preferably a first side abutment 31, and the first side abutment 31 and the prestressed tendons 16 may be fixed by an anchor, and the prestressed tensioning part preferably includes a second side abutment 30. The second side abutment 30 is provided with a steel beam 27 moving along the length of the prestressed tendons 16 and a driving tensioning device 28 for moving the steel beam 27, and the second side abutment 30 and the steel beam 27 are both provided with an anchor 20 for fixing the prestressed tendons 16.

In the embodiment of the invention, the first side abutment 31 is a non-tensioned side abutment for fixing one end of the prestressed tendons 16, and the second side abutment 30 is a tensioned side abutment which is fixed on the ground or a working table. The tension of the prestressed tendons 16 is achieved by driving the tensioning device 28 to drive the steel beam 27 to move. After the prestressed tendons 16 are stretched, the prestressed tendons 16 are fixed to the second side abutments 30 and the steel beams 27 by the anchors 20 to facilitate subsequent concrete pouring.

In the embodiment of the invention, the second side abutment 30 is preferably a trapezoidal bracket having an open slot in the middle, the steel beam 27 and the driving tensioning device 28 are disposed in open slot, the upper end and the lower end of the open slot are provided with rails 29 for moving the steel beam 27, and the open slots on both sides of the steel beam 27 are provided with a guard plate 19 for ensuring the moving direction of the steel beam 27. The second side abutment 30 adopts a trapezoidal shape to ensure stability during standing, and the central open slot is provided for placing the steel beam 27 and the driving tensioning device 28. The structure is simple, the space occupied by the device is saved, and the setting of the track 29 can reduce friction force received when the steel beam 27 moves, and lubricating oil may be applied between the steel beam 27 and the rail 29 to further reduce the friction force between the steel beam 27 and the rail 29.

Furthermore, in order to further increase the stability of the dedicated mold of the invention, the bracket 26 may also be provided in a triangular shape, and the first side abutment 31 may be provided in a trapezoidal shape.

Further, the driving tensioning device 28 is preferably a jack or lifting device that is fixed to the side wall of the open slot. Both the jack and the lifting device are lightweight and flexible, and can be operated by one person.

In still another aspect, the invention also provides a method for making the above-mentioned prefabricated prestressed thermal-insulated exterior wall board by using the above dedicated mold, comprising:

Step 1: calculating parameters: according to the actual project requirements, by comprehensively considering the service conditions including wind load, seismic action and temperature stress load, calculating and determining the sizes of the thermal-insulated core board 14 and the concrete layer 13, and determining the cross-section forms of the thermal-insulated core board rib 21 and the ribs of the concrete rib layer, the spacing between the reinforcement meshes 15, and the tension control stress and number of the prestressed tendons 16;

Step 2: making the thermal-insulated core board: according to the calculated size of the thermal-insulated core board 14 and the cross sectional form of the thermal-insulated core board rib 21, making a thermal-insulated material into the thermal-insulated core board 14 or customizing the thermal-insulated core board from a factory;

Step 3: binding the reinforcement mesh framework: inserting the shear-resistant connection member 17 between the adjacent thermal-insulated core board ribs 21, determining the distance between the reinforcement mesh 15 and the thermal-insulated core board 14, connecting the reinforcement mesh 15 with the shear-resistant connection member 17, and then placing the prestressed tendons 16 in the grooves formed between the adjacent thermal-insulated core board ribs 21 to form a reinforcement mesh framework;

In this step, the prestressed tendons 16 are freely placed in the grooves formed between the adjacent ribs of the thermal-insulated core board 14, and the prestressed tendons 16 are located between the thermal-insulated core board 14 and the reinforcement mesh 15.

In this step, the prestressed tendons 16 may be placed in the grooves formed between the adjacent thermal-insulated core board ribs 21, or also may be placed in the grooves formed between the adjacent concrete layer ribs, or may be placed in the groove formed between the adjacent thermal-insulated core board ribs 21 and in the groove formed between the adjacent concrete ribs simultaneously.

Step 4: positioning the supporting template and the reinforcement mesh framework: firstly, placing the reinforcement mesh framework sidewise into the cavity formed by the bottom template 23 and the side template 24 that have already been fixed, and the distance between the reinforcement mesh framework and the side template 24 is controlled according to the thickness of the concrete layer, and then the prestressed tendons 16 are passed through the end templates 25 at the two ends, and the end templates 25 are fixed to the two short sides of the bottom template 23; In this step, the modulus card strip can be used to control the distance between the reinforcement mesh framework and the side template 24, and the bottom template 23 with the side template 24, the end template 25 with the bottom template 23 and the side template 24 can be bolted.

Step 5: arranging the prestressed tendons and the tensioning device: firstly fixing the prestressed tendons 16 extending from one end of the end template 25 to the fixing part, and then fixing the prestressed tendons 16 extending from the other end of the end template 25 on the steel beam 27, and then tensioning the prestressed tendons by moving the steel beam 27; unloading to a calculated tension control stress after maintaining the load for a certain time, and fixing the prestressed tendons 16 to the prestressed tensioning part;

In this step, when the prestressed tendons are tensioned, in order to reduce the loss of the prestress, the tensile strength needs to exceed 5% of the calculated tension control stress, and unloading is performed after the load is maintained for 2 to 5 minutes.

Step 6: pouring concrete layer: pouring the concrete from top to bottom from above the template body, and after pouring, troweling the surface of the concrete layer, and then curing;

In this step, in order to ensure the compaction of the concrete layer during the pouring process, self-compacting concrete is preferably used, and the vibrating rod may be used for the side vibrating during the pouring process. When the concrete layer is cured, the driving tensioning device 28 no longer applies tension to the steel beam 27, and only the anchors on the first side abutment 31 and the second side abutment 30 maintain the tension of the prestressed tendons 16.

Step 7: releasing the prestressed tendons: after the strength of the concrete to be poured reaches 70 to 75% of the expected strength, releasing the prestressed tendons; In this step, the concrete test block of 150 mm×150 mm×150 mm can be poured at the same time as the concrete is poured, and then the strength of the concrete test block is tested after curing for a certain time, and if the strength of the concrete test block reaches 70 to 75% of the expected strength, it can be determined that the strength of the concrete layer in the template body also reaches 70 to 75% of the expected strength.

Step 8: demolding: after the concrete reaches the expected strength, demolding the prefabricated prestressed thermal-insulated exterior wall board.

When a plurality of prefabricated prestressed thermal-insulated exterior wall boards are simultaneously produced using the dedicated mold of the invention, in step 4, the middle partitions 32 should also be embedded between the two side templates 24. After the distance between the reinforcement mesh framework and the side template 24 is controlled depending on the thickness of the concrete layer, the prestressed tendons 16 are passed through the middle partition 32 and the end templates 25 at both ends, and then the end templates 25 at both ends are respectively fixed to the two short sides of the bottom template 23 and two side templates 24.

In respect to the specific bearing capacity of the prefabricated prestressed thermal-insulated exterior wall board of the invention, the inventors designed and conducted a bending test. The test was designed to produce two composite exterior wall boards with ribbed slabs. The dimensions of the two composite exterior wall boards were 3200 mm long, 600 mm wide and 150 mm thick. One of the composite exterior wall boards was the prefabricated prestressed thermal-insulated exterior wall board of the invention and was manufactured by the dedicated mold and method of the invention, wherein the prestressed tendons were selected from the 1570 grade $\varphi^5$ stress-relief spiral rib steel wires, which were symmetrically arranged on the two sides of the thermal-insulated core board, each side was provided with 4 to 8 wires, with $0.4f_{ptk}$ of tension applied to each of the prestressed tendons ($f_{ptk}$ was the ultimate strength standard value of the prestressed tendons). The other composite exterior wall board was not prestressed, and the rest of the structure was the same as that of the prefabricated prestressed exterior wall board of the invention.

The bending test results showed that the cracking load of the composite exterior wall board without prestress was 4.3 $kN/m^2$; while the cracking load of the prefabricated prestressed thermal-insulated exterior wall board of the invention reached 9.7 $kN/m^2$, and the cracking load was increased by 126% relative to the composite exterior wall board without prestress. It could be seen that the application of prestress could significantly increase the cracking load of the ribbed composite exterior wall board, reduce the generation of cracks, and improve the quality of the product.

The prefabricated prestressed thermal-insulated exterior wall board, the special mold and the making method thereof have the following beneficial effects:

1. The prefabricated prestressed thermal-insulated exterior wall board of the invention is symmetrically arranged with the prestressed tendons in grooves formed between the adjacent thermal-insulated core board ribs and/or grooves formed between the adjacent concrete ribs, thereby improving the rigidity of the wallboard, causing the concrete to be in a stressed state, effectively preventing the lifting process and the generation of cracks during use, and prolonging the service life of the exterior wall board.

2. The prefabricated prestressed thermal-insulated exterior wall board of the invention changes the composite form of the conventional three layers of flat plates, and adopts a combination of a ribbed thermal-insulated core board and a concrete layer, and provides a concrete layer rib for wrapping only at the position of the shear-resistant connection member, and the remaining part is filled with the thermal-insulated core board, which reduces the self-weight under the premise of ensuring sufficient strength, saves the transportation cost, reduces the dynamic performance of the wall board under the wind load and the seismic load, which is beneficial to the seismic design.

3. The prestress in the prefabricated prestressed thermal-insulated exterior wall board of the invention is applied in the way of the integral mechanical tensioning of the vertical mold, and the distance of tension part is adjustable, which enables production in batch.

4. The prefabricated prestressed thermal-insulated exterior wall board of the invention has the characteristics of small mass and high rigidity, so that it can be applied to the high-rise building where the environment is more complex because of the wind, which breaks through the application limit of the traditional composite exterior wall board.

5. The prefabricated prestressed thermal-insulated exterior wall board of the invention has a thickness of the thermal-insulated layer increased by the ribbed thermal-insulated core board compared with the conventional flat thermal-insulated core board, and can significantly improve the thermal-insulated performance and the sound insulation performance.

6. The prefabricated prestressed thermal-insulated exterior wall board of the invention is fully prefabricated and processed by the factory, and only needs to be bolted by the embedded components at the site, which can be easily loaded and unloaded, improves the construction efficiency, reduces the welding operation on the site and the pollution, and is benefit for the development of building industrialization.

The shear-resistant connection member described in the above embodiment 2 may be a flexible connection member, such as a diagonal reinforcement, a truss reinforcement, a reinforced glass fiber (GFRP) truss, a GFRP rod; or a rigid connection member such as an H-type steel beam, an H-type honeycomb steel beam, an H-type GFRP beam, an H-type GFRP honeycomb beam, a stainless steel connection member, a square steel connection member, a T-type connection member and the like can be used.

The above description is a preferred embodiment of the invention, and it should be noted that those skilled in the art can also make several improvements and modifications without departing from the principles of the invention. The improvements and modifications should be considered as the protection scope of the invention.

The invention claimed is:

1. A method of making a lightweight composite thermal-insulated exterior wall board comprising:

a thermal-insulated core board provided with a plurality of throughout-length thermal-insulated core board ribs, a reinforcement mesh on both sides of the thermal-insulated core board, a concrete layer that is cast on the reinforcement mesh and is provided with a plurality of concrete ribs interlaced with and matching the thermal-insulated core board ribs, and a shear-resistant connector connected with the reinforcement mesh that is inserted between adjacent thermal-insulated core board ribs, an angle between the shear-resistant connector and a horizontal plane of the thermal-insulated core board being 45°, concrete ribs for wrapping being only provided on part of the shear-resistant connector, the method comprising:

step 1: calculating parameters: according to actual project requirements, by comprehensively considering service conditions including wind loads, seismic actions and temperature stress loads, calculating and determining a size of the thermal-insulated core board and the concrete layer, and determining cross-section forms of the thermal-insulated core board ribs and the concrete ribs;

step 2: making the thermal-insulated core board: according to the calculated size of the thermal-insulated core board and the cross-section form of the thermal-insulated core board ribs, making a thermal-insulated material into the thermal-insulated core board or customizing the thermal-insulated core board from a factory;

step 3: binding a reinforcement mesh truss core board: inserting the shear-resistant connector between the adjacent thermal-insulated core board ribs, and determining a distance between the reinforcement mesh and the thermal-insulated core board, and then connecting the reinforcement mesh with the shear-resistant connector to form the reinforcement mesh truss core board;

step 4: disposing a dedicated mold for making the lightweight composite thermal-insulated exterior wall board comprising a bottom template, two mutually parallel end templates including a first end template and a second end template, and two mutually parallel vertical templates including a first vertical template and a second vertical template, the vertical templates and the end templates being respectively connected with four sides of the bottom template: firstly disposing the bottom template, and then fixing the first vertical template and the first end template respectively to two mutually perpendicular sides of the bottom template;

step 5: positioning the reinforcement mesh truss core board: firstly placing the reinforcement mesh truss core board sidewise into the bottom template and the first vertical template that have been fixed, and arranging the thermal-insulated core board ribs vertically, and then controlling a distance between the reinforcement mesh truss core board and the first vertical template according to a thickness of the concrete layer;

step 6: disposing the second vertical template and the second end template on the other side: fixing the second vertical template on the bottom template, and under the premise of ensuring that a net size in the dedicated mold is respectively thickness, height, and width of the lightweight composite thermal-insulated exterior wall board, and finally fixing the second end template to the bottom template;

step 7: pouring the concrete layer: pouring the concrete from top to bottom above the dedicated mold, and after pouring, leveling a surface of the concrete layer, and then curing; and step 8: demolding: after the concrete reaches an expected strength, demolding the lightweight composite thermal-insulated exterior wall board.

2. The method according to claim 1, wherein when a plurality of lightweight composite thermal-insulated exterior wall boards are simultaneously cast using the dedicated mold, in said step 5, said reinforcement mesh truss core board and partitions are sequentially placed sidewise into the bottom template and the first vertical template that have been fixed, and the thermal-insulated core board ribs are vertically arranged, so that grooves of the partitions match convexes of the first end template until all the reinforcement mesh truss core board and the partitions are placed.

3. A prefabricated prestressed thermal-insulated exterior wall board, comprising a lightweight composite thermal-insulated exterior wall board comprising:

a thermal-insulated core board provided with a plurality of throughout-length thermal-insulated core board ribs, a reinforcement mesh on both sides of the thermal-insulated core board, and a concrete layer that is cast on the reinforcement mesh and is provided with a plurality of concrete ribs interlaced with and matching the thermal-insulated core board ribs, wherein:

a shear-resistant connector connected with the reinforcement mesh is inserted between adjacent thermal-insulated core board ribs, an angle between the shear-resistant connector and a horizontal plane of the thermal-insulated core board is 45°, concrete ribs for wrapping are only provided on part of the shear-resistant connector, and prestressed ribs are provided in grooves formed between the adjacent thermal-insulated core board ribs and grooves formed between adjacent concrete ribs.

4. The prefabricated prestressed thermal-insulated exterior wall board according to claim 3, wherein prestressed tendons are consolidated in a centroid region of the concrete ribs.

5. The prefabricated prestressed thermal-insulated exterior wall board according to claim 3, wherein cross sections of the thermal-insulated core board ribs and the concrete ribs are trapezoidal or wavy.

6. The prefabricated prestressed thermal-insulated exterior wall board according to claim 3, wherein the thermal-insulated core board is made of a thermal-insulated material.

7. The prefabricated prestressed thermal-insulated exterior wall board according to claim 3, wherein rabbets are provided around an outside of the concrete layer.

8. A dedicated mold for making the prefabricated prestressed thermal-insulated exterior wall board according to claim 3, comprising a template body and a tensioning device, wherein:

the template body comprises a bottom template, two side templates and two end templates, the two side templates are respectively connected with two long sides of the bottom template, the two end templates are respectively connected with two short sides of the bottom template and two side templates, and each end template is provided with through-holes for passage of prestressed tendons; and the tensioning device includes a fixing part at one end of the template body for fixing the prestressed tendons and a prestressed tensioning part at the other end of the template body for tensioning the prestressed tendons.

9. The dedicated mold according to claim 8, wherein a plurality of middle partitions are disposed in a cavity of the template body, and the plurality of middle partitions are embedded between the two side templates, and through-holes for passage of the prestressed tendons are disposed on the plurality of middle partitions.

10. The dedicated mold according to claim 8, wherein the fixing part is a first side abutment, and the first side abutment and the prestressed tendons are fixed by an anchor, the prestressed tensioning part includes a second side abutment, and the second side abutment is provided with a steel beam movable along a length direction of the prestressed tendons and a driving tensioning device for moving the steel beam, and the second side abutment and the steel beam are both provided with anchors for fixing the prestressed tendons.

11. The dedicated mold according to claim 8, wherein a second side abutment is a trapezoidal bracket having an open slot in a middle, a steel beam and a driving tensioning device are disposed in the open slot, an upper end and a lower end of the open slot are provided with rails for moving the steel beam, and both sides of the steel beam are provided with a guard plate for ensuring a moving direction of the steel beam.

12. The dedicated mold according to claim 11, wherein said driving tensioning device is a jack or lifting device that is fixed to a side wall of the open slot.

13. A method of making the prefabricated prestressed thermal-insulated exterior wall board according to claim 3 by using a dedicated mold for making the prefabricated prestressed thermal-insulated exterior wall board comprising:

a template body including a bottom template, two side templates and two end templates, the two side templates being respectively connected with two long sides of the bottom template, the two end templates being respectively connected with two short sides of the bottom template and two side templates, and each end template being provided with through-holes for passage of prestressed tendons; and a tensioning device including a fixing part at one end of the template body for fixing the prestressed tendons and a prestressed tensioning part at the other end of the template body for tensioning the prestressed tendons, the method comprising:

step 1: calculating parameters: according to actual project requirements, by comprehensively considering a role of service conditions, calculating and determining a size of the thermal-insulated core board and the concrete layer, and determining a cross-section form of the thermal-insulated core board ribs and the concrete ribs, a spacing between reinforcement meshes, and a tension control stress and number of the prestressed tendons, the service conditions including wind loads, seismic actions and temperature stress loads;

step 2: making the thermal-insulated core board: according to the calculated size of the thermal-insulated core board and the cross-section form of the thermal-insulated core board ribs, making a thermal-insulated material into the thermal-insulated core board or customizing the thermal-insulated core board from a factory;

step 3: binding a reinforcement mesh framework: inserting the shear-resistant connector between the adjacent thermal-insulated core board ribs, determining a distance between the reinforcement mesh and the thermal-insulated core board, then connecting the reinforcement mesh with the shear-resistant connector, and then placing the prestressed tendons in the grooves formed between the adjacent thermal-insulated core board ribs to form the reinforcement mesh framework;

step 4: positioning a supporting template and the reinforcement mesh framework: firstly, placing the reinforcement mesh framework sidewise into a cavity formed by connecting the bottom template and the side template that have already been fixed, controlling a distance between the reinforcement mesh framework and the template body according to a thickness of the concrete layer, and then enabling the prestressed tendons to pass through the end templates of the two ends, and fixing the end templates of the two ends to the two short sides of the bottom template and the two side templates respectively;

step 5: arranging the prestressed tendons and the tensioning device: firstly fixing the prestressed tendons extending from the end template at one end to the fixing part, and then fixing the prestressed tendons extending from the end template at the other end on a steel beam, and then tensioning the prestressed tendons by moving the steel beam; unloading to a calculated tension control stress after maintaining the load for a certain time, and fixing the prestressed tendons to the prestressed tensioning part;

step 6: pouring concrete layer: pouring concrete from top to bottom from above the template body, and after pouring, leveling a surface of the concrete layer, and then curing;

step 7: releasing the prestressed tendons: after a strength of the concrete to be poured reaches 70 to 75% of an expected strength, releasing the prestressed tendons; and step 8: demolding: after the concrete reaches the expected strength, demolding the prefabricated prestressed thermal-insulated exterior wall board.

14. The method according to claim 13, wherein in step 5, when the prestressed tendons are tensioned, a tensile strength needs to exceed 5% of a calculated tensile strength.

15. The prefabricated prestressed thermal-insulated exterior wall board according to claim 6, wherein the thermal-insulated material is selected from the group consisting of XPS, EPS, and polyphenylene granule mortar.

* * * * *